US010376738B2

(12) United States Patent
Baril et al.

(10) Patent No.: US 10,376,738 B2
(45) Date of Patent: Aug. 13, 2019

(54) PHYSICAL THERAPY DEVICE FOR LOWER LIMBS AND THERAPEUTIC METHODS THEREOF

(71) Applicants: Martin Baril, Ste-Agathe-des-Monts (CA); Claudine Cloutier, Ste-Agathe-des-Monts (CA)

(72) Inventors: Martin Baril, Ste-Agathe-des-Monts (CA); Claudine Cloutier, Ste-Agathe-des-Monts (CA)

(73) Assignees: Martin Baril, Ste-Agathe-des-Monts (CA); Claudine Cloutier, Ste-Agathe-des-Monts (CA)

( * ) Notice: Subject to any disclaimer, the term of this patent is extended or adjusted under 35 U.S.C. 154(b) by 107 days.

(21) Appl. No.: 15/387,021

(22) Filed: Dec. 21, 2016

(65) Prior Publication Data

US 2017/0182359 A1 Jun. 29, 2017

(30) Foreign Application Priority Data

Dec. 23, 2015 (CA) ..... 2916227

(51) Int. Cl.

| | |
|---|---|
| ***A63B 21/00*** | (2006.01) |
| ***A63B 21/22*** | (2006.01) |
| ***A63B 23/04*** | (2006.01) |
| ***A63B 21/012*** | (2006.01) |

(52) U.S. Cl.

CPC ..... *A63B 23/04* (2013.01); *A63B 21/00069* (2013.01); *A63B 21/012* (2013.01); *A63B 21/22* (2013.01); *A63B 21/4011* (2015.10); *A63B 21/4045* (2015.10)

(58) Field of Classification Search

CPC ..... A63B 21/00058; A63B 21/00069; A63B 21/00072; A63B 21/00076;

(Continued)

(56) References Cited

U.S. PATENT DOCUMENTS 2,455,274 A * 11/1948 Scriver ..... A63B 69/18 434/253
3,531,110 A * 9/1970 Marchu ..... A63B 69/18 482/146

(Continued)

FOREIGN PATENT DOCUMENTS

CN 104546381 A * 4/2015 ..... A61H 1/02
WO WO-2014005035 A1 * 1/2014 ..... A63B 21/02

*Primary Examiner* — Gary D Urbiel Goldner
(74) *Attorney, Agent, or Firm* — Brouillette Legal Inc.; Robert Brouillette

(57) ABSTRACT

The invention concerns a device and methods for unilateral or bilateral physical therapy of lower limbs of a person. The device comprises a curved rail mounted on a base and a pair of support members on which the legs are disposed. The curved rail is configured to allow lateral movements of the lower limbs with the support members, the lateral movements being driven by a force of the lower limbs. The initial reinforcement of the lower limbs of the person is improved by the use of this device, which reduces friction or resistance caused by the device during prescribed movements. The invention provides to patients with severe lower limb disability a physical therapy device that is easy to use with minimum supervision by a physical therapist.

16 Claims, 18 Drawing Sheets

(58) Field of Classification Search
CPC ..... A63B 21/00185; A63B 21/012; A63B 21/068; A63B 21/22; A63B 21/4011; A63B 21/4013; A63B 21/4015; A63B 21/4027; A63B 21/4033; A63B 21/4034; A63B 21/4045; A63B 21/4047; A63B 21/4049; A63B 22/0015; A63B 22/0017; A63B 22/0025; A63B 22/0046; A63B 22/20; A63B 22/201; A63B 22/203; A63B 2022/0028; A63B 2022/206; A63B 23/035; A63B 23/03508; A63B 23/03516; A63B 23/03533; A63B 23/03541; A63B 23/04; A63B 23/0405; A63B 23/0482; A63B 23/0488; A63B 23/0494; A63B 69/0022; A63B 69/0057; A63B 69/0059; A63B 69/18; A63B 2069/0062; A63B 71/0054; A63B 2071/0063; A63B 2071/0072; A63B 2071/0081; A63B 2208/0209; A63B 2208/0228; A63B 2208/0238; A63B 2208/0242; A63B 2208/0252; A63B 2208/0266; A63B 2225/09; A63B 2225/093; A63B 2244/18; A63B 2244/19
See application file for complete search history.

(56) References Cited

U.S. PATENT DOCUMENTS 4,149,713 A * 4/1979 McLeod ..... A63B 23/03533 482/101
4,625,960 A * 12/1986 Gvoich ..... A63B 21/0083 137/597
4,911,430 A * 3/1990 Flament ..... A63B 69/18 434/253
5,496,239 A * 3/1996 Kallman ..... G09B 9/02 482/51
6,090,022 A * 7/2000 Colecchi ..... A61H 1/0292 482/131
6,368,254 B1 * 4/2002 Wall ..... A63B 21/055 482/122
6,569,064 B1 * 5/2003 Loane ..... A63B 21/154 482/146
7,846,073 B2 * 12/2010 Summers ..... A63B 21/0603 482/135
8,591,349 B1 * 11/2013 Jones ..... A63B 69/3644 473/229
9,440,105 B1 * 9/2016 Lee ..... A63B 23/04
9,586,079 B1 * 3/2017 Jones ..... A63B 21/0552
2004/0014569 A1 * 1/2004 Loane ..... A63B 21/0552 482/70
2004/0241631 A1 * 12/2004 Nizamuddin ..... A63B 21/055 434/253
2005/0079956 A1 * 4/2005 Bruno ..... A63B 22/203 482/51
2006/0223681 A1 * 10/2006 Loane ..... A63B 22/16 482/71
2006/0287168 A1 * 12/2006 Nizam ..... A63B 21/055 482/71
2009/0176631 A1 * 7/2009 Blessing ..... A63B 22/0061 482/71
2014/0100088 A1 * 4/2014 Ho ..... A63B 23/0227 482/131

* cited by examiner

PHYSICAL THERAPY DEVICE FOR LOWER LIMBS AND THERAPEUTIC METHODS THEREOF

CROSS-REFERENCE TO RELATED APPLICATIONS

The present patent application claims the benefits of priority of commonly assigned Canadian Patent Application no. 2,916,227, entitled "Physical therapy device for lower limbs" and filed at the Canadian Patent Office on Dec. 23, 2015, the content of which is incorporated herewith by reference.

FIELD OF THE INVENTION

The present invention generally relates to a device and method for physical therapy, and more particularly to a device and method for physical therapy of the lower limbs of a person.

BACKGROUND OF THE INVENTION

Following a lower limb injury or trauma like sprains, strains, contusions, denervated muscle, articular surgery or amputation, the force of the legs is severally impaired so that the injured person often has to perform physical therapy to regain functional control of their lower extremities. Physical therapy or rehabilitation of lower limbs usually requires the presence of a physical therapist at the bedside of the patient to provide postural cues and general strengthening of muscles thought to aid in desired motion or control faulty movement pattern. Indeed, during the first steps of the therapy, some patients are even not able to move their legs lying on a bed because the surface of the bed provides too much friction or resistance for proper lateral movement of their legs.

In the past, various exercise machines have been designed to mimic the functional movement of the legs, such as abduction, adduction, extension or flexion of the legs. However, these machines impose a significant resistance to the movement of the lower limbs so that a person with severe reduction of leg strength would not be able to use. Moreover, these machines are generally configured for only one type of movement with a limited range of motion in abduction, adduction, extension or flexion of the legs. They generally involve cumbersome and expensive equipment that are not adaptable for home use.

In particular, U.S. Pat. No. 4,625,960 (Gvoich et al.) teaches an abductor-adductor exercise device that is portable. This device comprises a pair of knee rest movable in a lateral direction along a straight rail in response to the movement of the legs. The operation of the device is based on the cushioning effect of air by adjusting the resistance of the unit. Such complex assembly of a resistance system, including air cylinders, pistons and valves, unnecessarily increases the weight and the fabrication cost of a unit. More importantly for the patient, since the rail is a straight line, this device provides a limited range of motion in abduction or adduction.

The Chinese application no. CN 104546381 (Rongjuan et al.) teaches a similar device than Gvoich et al. with a pair of support members movable in a lateral direction along a straight rail. However, the movement of the support members is powered by a motor oil pump, which also increases the weight and the fabrication cost of a unit.

Therefore, there is a need to provide a physical therapy device for lower limbs that is affordable, portable and adaptable for home use or at the bedside of a patient, which also adapted to allow for a full range of motion with minimum resistance in abduction, adduction, extension or flexion of the legs.

SUMMARY OF THE INVENTION

One of the objectives of the present invention is to provide a light and portable device that can be easily installed on the bed of a patient. The device may allow for a full range of motion of the legs with minimum resistance. Indeed, the initial reinforcement of the lower limbs of a person may be improved by the use of this device, which reduces the friction or the resistance caused by the device during the prescribed movements.

The aforesaid and other objectives of the present invention are realized by generally providing a device for unilateral or bilateral physical therapy of lower limbs of a person, the device comprising:

- a curved rail mounted on a base,
- a pair of support members connected to the rail, each support member being configured to hold a portion of a leg of the person and to slide along the curved rail,
- wherein the curved rail allows lateral movements of the lower limbs with the support members, said movements being driven by a force of the lower limbs.

Another aspect of the present invention is to provide a method for unilateral physical therapy of a lower limb of a person. The method comprising the steps of:

a) positioning a portion of a leg of the person on a support member; said support members being configured to slide along a curved rail mounted on a base; and b) moving the support member in a lateral movement along the rail, said movement being driven by a force of the lower limb of the person during a unilateral physical therapy.

Another aspect of the present invention is to provide a method for bilateral physical therapy of lower limbs of a person. The method comprising the steps of:

a) positioning a portion of a first leg of the person on a first support member; said first support members being configured to slide along a curved rail mounted on a base;

b) positioning a portion of a second leg of the person on a second support member; said second support member being configured to slide along the curved rail mounted on the base; and c) moving the first and second support members in lateral movements along the curved rail, said lateral movements being driven only by a force of the lower limbs of the person during a bilateral physical therapy.

The present invention provides to patients with severe lower limb disability, a physical therapy device that is easy to use with minimum supervision by a physical therapist. Consequently, the patient may perform their physical therapy exercise with more assiduity and thereby may accelerate the rehabilitation of the lower limbs compared to the use of common exercise machines or following verbal and tactile cues made periodically by a physical therapist. In addition, one of the positive outcomes of such device may be to improve the workload management of the physical therapists and reduce excessive sustained effort by them during treatment of a patient, mostly while treating heavily built people.

BRIEF DESCRIPTION OF THE DRAWINGS

The above and other objects, features and advantages of the invention will become more readily apparent from the following description, reference being made to the accompanying drawings in which.

DETAILED DESCRIPTION OF THE PREFERRED EMBODIMENT

A novel physical therapy device and therapy method will be described hereinafter. Although the invention is described in terms of specific illustrative embodiment(s), it is to be understood that the embodiment(s) described herein are by way of example only and that the scope of the invention is not intended to be limited thereby.

Figure 1:
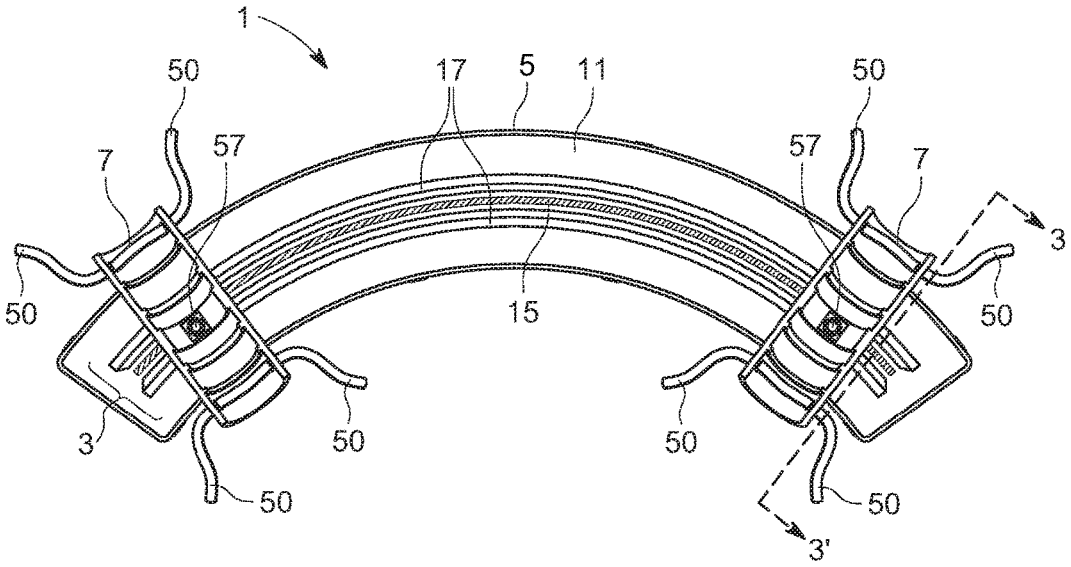
FIG. 1 is a top view of the device according to a preferred embodiment of the present invention.
Figure 2:
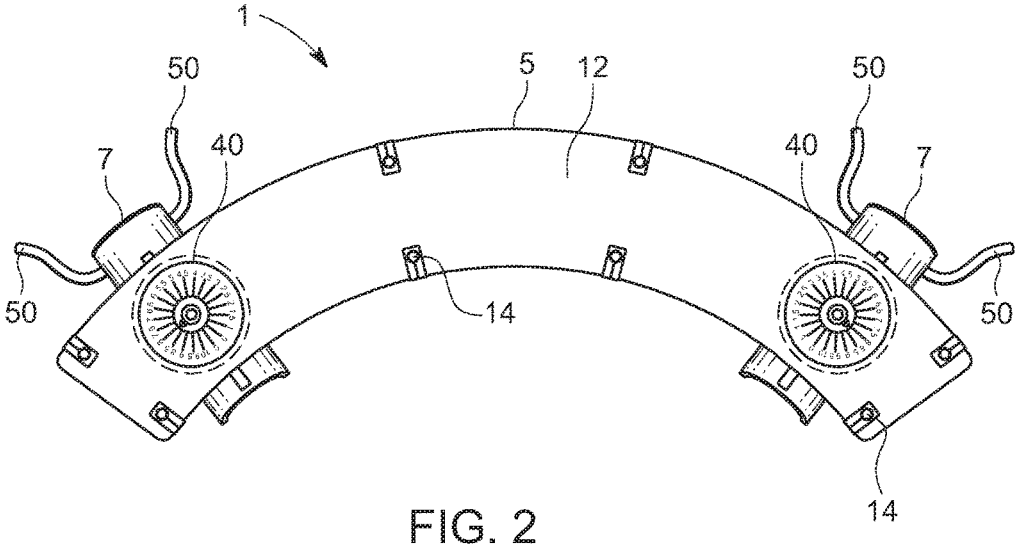
FIG. 2 is a bottom view of the device illustrated on FIG. 1.

Referring first to FIGS. 1 and 2, the device 1 of the present invention may comprise a curved-shaped rail 3 mounted on a base 5, and a pair of support members 7 connected the rail 3 so that each support member can laterally slide along the rail. Each support member 7 is adapted to accommodate a portion of a leg of a person, preferably the foreleg. The lateral movements of the support members 7 along the rail 3 are passive meaning that they are driven by a force of the lower limbs of the person without involving any motor or actuator means.

The rail 3 has a curved shape for guiding the movement of the legs within the hip-joint axe of rotation, thus facilitating the movement and allowing for a full range of motion in adduction and abduction. In a preferred embodiment, the curved rail 3 has a radius of about 737 mm, which could be adapted to be use by person of height 1.50 to 1.85 meters. Other devices can be made with curved rail 3 of different radius so that the device 1 may be adapted to be used by persons of different height, ranging from children to tall persons.

Figure 3:
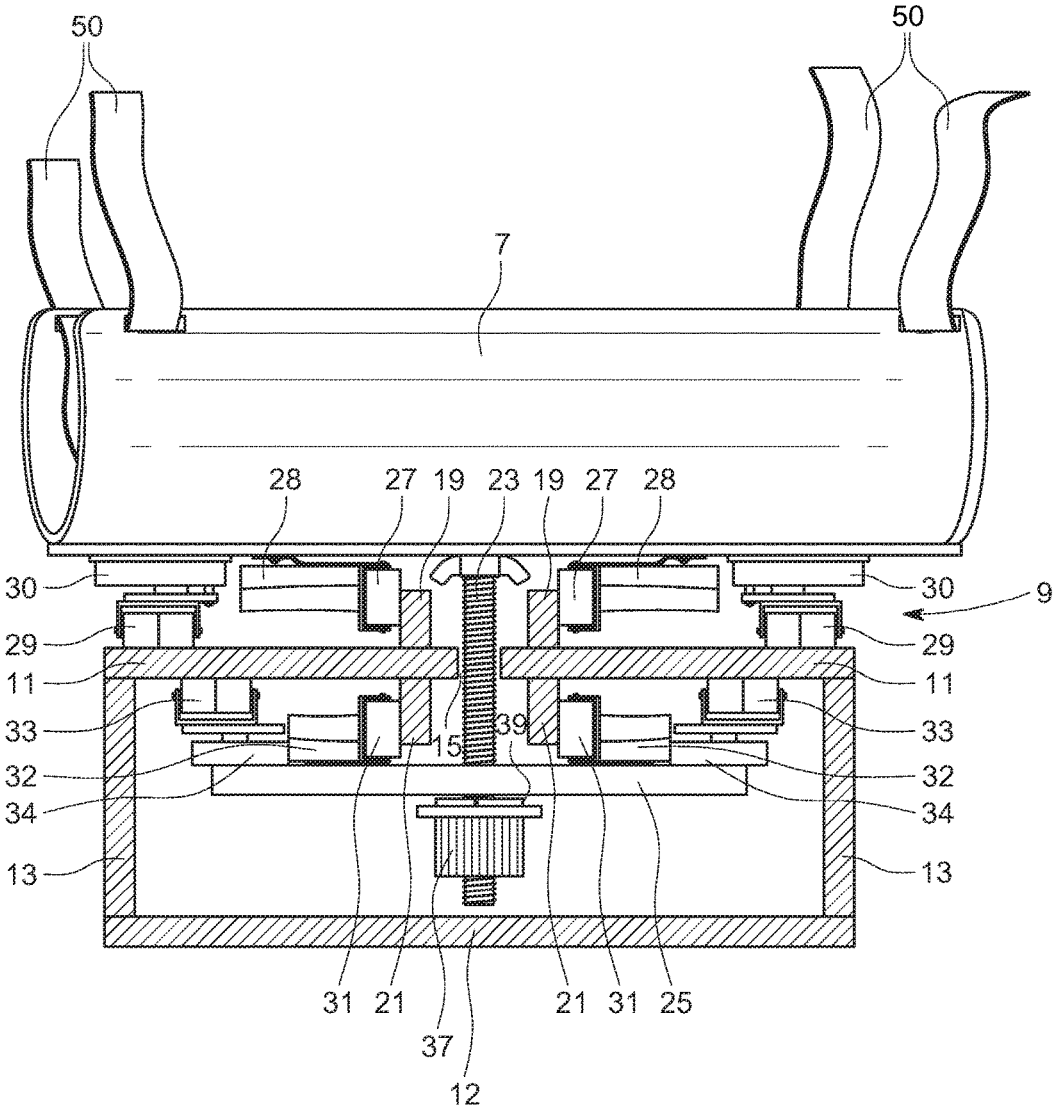
FIG. 3 is a cross sectional view of the device along the 3-3' axis shown on FIG. 1.

Moreover, as illustrated in FIG. 3, each support member 7 may comprise a lateral sliding system 9, which engages the rail with substantially antifriction interaction for facilitating lateral movements of the member supports along the rail.

Still referring to FIG. 3, the base 5 may comprise a top portion 11 for supporting the rail 3 and at least two side longitudinal walls 13 for supporting the top portion 11. The base 5 may also comprise a floor 12, which can be fixed to the walls 13 using mounting screws 14. The floor 12 may further comprise non-slip backing to avoid unfavourable movement of the device during physical therapy exercise.

In a preferred embodiment, the base 5 has a length of about 1 meter, a width of about 15 centimeters and a height of about 6 centimeters. The base 5 thus elevates the height of the support members 7 at a level in which the legs of the person are aligned comfortably for proper physical therapy exercise. Moreover, the base 5 has a curved shape associated with the curved shape of the rail 3. During operation, this particular shape of the base may allow more freedom of movement of the legs on the support members 7. Also, the base 5 may be made of substantially light material such as, but not limited to, plastic, Polyvinyl chloride (PVC) or Poly(methyl methacrylate) (known as Plexiglas™), in order to ease the transport of the device.

The base 5 defines a curved slot 15 along a mid-section of the top portion. The rail comprises a pair of guidance plates 17 located along both edge of the slot 15. Each guidance plate 17 defines a top section 19 extending outwardly from the top portion 11 of the base and a lower section 21 extending inwardly from the top portion 11 of the base. In a preferred embodiment, the top section 19 and the lower section 21 of the guidance plate 17 have a height of about 125 mm.

Still referring to FIG. 3, the lateral sliding system 9 comprises a plurality of wheels supported by a central pedestal 23 extending from each support members 7 through the slot 15 for guiding the lateral movement of the support members 7 along the curved rail 3. In a preferred embodiment, the central pedestal 23 has a length of about 76 mm. This particular length of the pedestal 23 is first adapted to support the support member 7 at about 19 mm above the top portion 11 of the base, and about 6 mm above the top section 19 of the guidance plate 17. Second, the pedestal 23 extend below the rail 3 by a length of about 5 mm in order to support the structures of the lateral sliding system 9 and the adjustable resistance system that are located below the top portion of the base 11, as described in more details below.

The lateral sliding system 9 may comprise a friction plate 25 connected to the central pedestal 23 inside the base 5 under the top portion 11. The plurality of wheels may comprise:

- a pair of top guidance wheels 27 operatively attached to the support member 7 and configured to engage the top section of the guidance plates 19;
- a pair of top friction wheels 29 operatively attached to the support member 7 and configured to engage the top portion of the base 11;
- a pair of lower guidance wheels 31 operatively attached to the friction plate 25, and configured to engage the lower section of the guidance plates 21; and
- a pair of lower friction wheels 33 operatively attached to the friction plate 25 and configured to engage the top portion the base 11.

The aforesaid plurality of wheels are adapted to slide or roll on their respective surface of contact with a minimum of friction in order to facilitate as much as possible the movement of the legs of a person with severe lower limb deficiency. Such wheels may be made of, but not limited to, plastic, rubber or polytetrafluoroethylene (known as Teflon™).

Furthermore, the plurality of wheels may comprise damping pads made of elastomeric material such as, but not limited to, rubber. The damping pads may comprise:

- a pair of top guidance damping pads 28 located between the top guidance wheels 27 and the support member 7;
- a pair of top friction damping pads 30 located between top friction wheels 29 and the support member 7;
- a pair of lower guidance damping pads 32 located between the lower guidance wheels 31 and the friction plate 25; and
- a pair of lower friction damping pads 34 located between the lower friction wheels 33 and the friction plate 25.

The top and lower guidance pads 28, 32, aim at fine-tuning the contact of the guidance wheels 27, 31 with the guidance plates 17 by allowing some subtle rotation of the support member 7 along its central axis for more comfort during movement.

The top and lower friction damping pads 30, 34 aim at reducing vibration of the friction wheels 29, 33 during the lateral movement of the support members 7 and at optimizing an adjustable resistance system, as described below.

Still referring to FIG. 3, the lateral sliding system 9 may further comprise an adjustable resistance system for increasing interactions between the friction wheels 29, 33 and the top portion of the base 11 to obtain a level of resistance adapted to the force required by the lower limbs of a person to move the member supports 7 along the rail 3 during the physical therapy. This resistance system may be adjustable on each lateral sliding system independently.

For example, the resistance system of one lateral sliding system 9 is adapted to be adjusted at a maximum level of friction to block the lateral movement of one of the member supports 7, leaving the other member support 7 movable for a unilateral physical therapy exercise.

The level of resistance or friction may be modulated by the adjustable resistance system, which may comprise a nut 37 mounted on the central pedestal 23 below the friction plate 25. The nut may be adapted to engage complementary threads on the central pedestal 23, so that in use, an upward screw movement of the nut 37 pushes the friction plate 25 towards the top portion of the base 11 and pulls the support members 7 towards the top portion of the base 11, for increasing the friction of the friction wheels 29, 33, on the top portion of the base 11. Consequently, the wheels may also compress the friction damping pads 30, 34 for optimizing the effect of resistance. Inversely, a downward unscrew movement of the nut reduces the aforesaid friction of the friction wheels 29, 33.

The adjustable resistance system may comprises a lock washer 39 mounted on the central pedestal located between the nut 37 and the friction plate 25 for preventing a disengagement of the nut 37 upon vibration.

Figure 4:
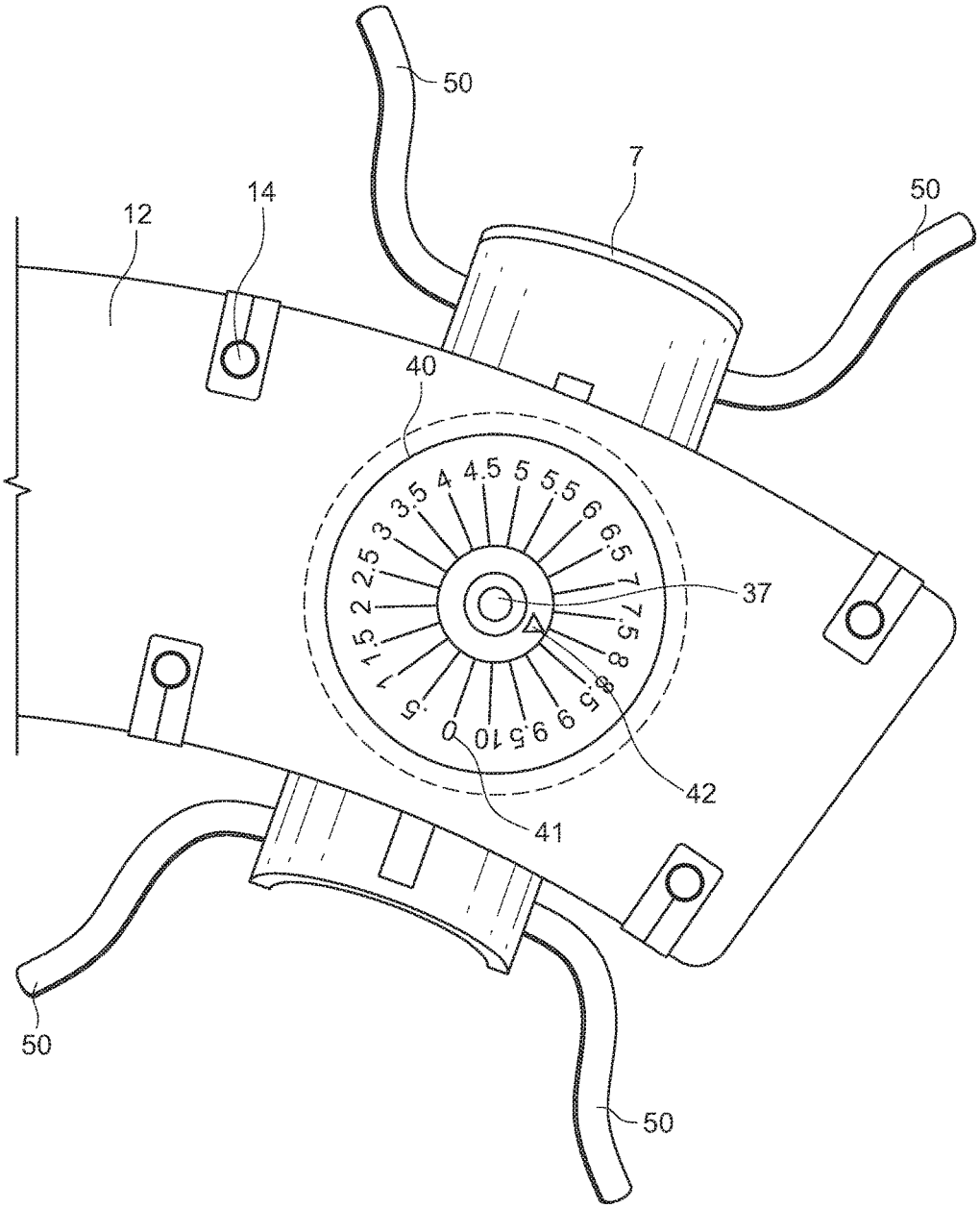
FIG. 4 is a bottom view of a portion of the device according to a preferred embodiment of the present invention with one of the support member mounted thereon comprising a graduated tension indicator.
Figure 5:
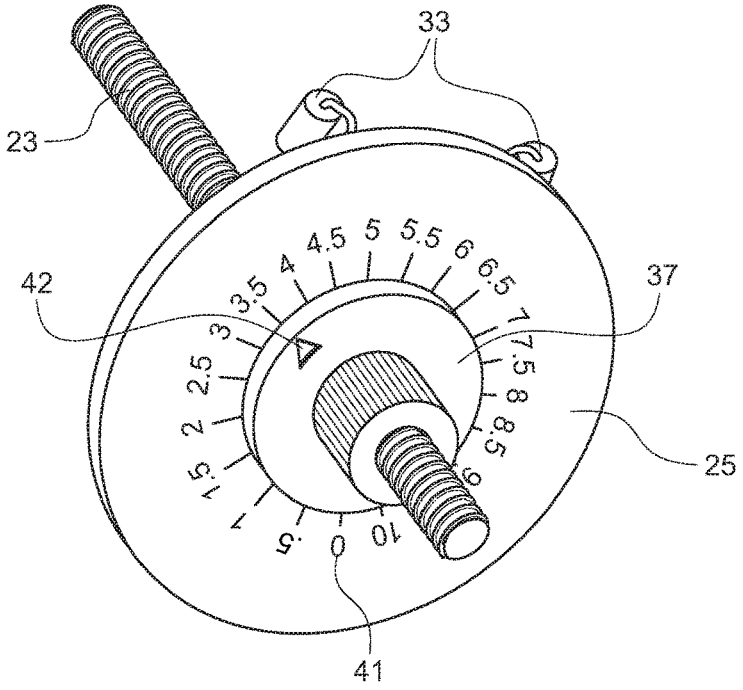
FIG. 5 is a side elevation view of the graduated tension indicator mounted on the central pedestal according to a preferred embodiment.
Figure 6:
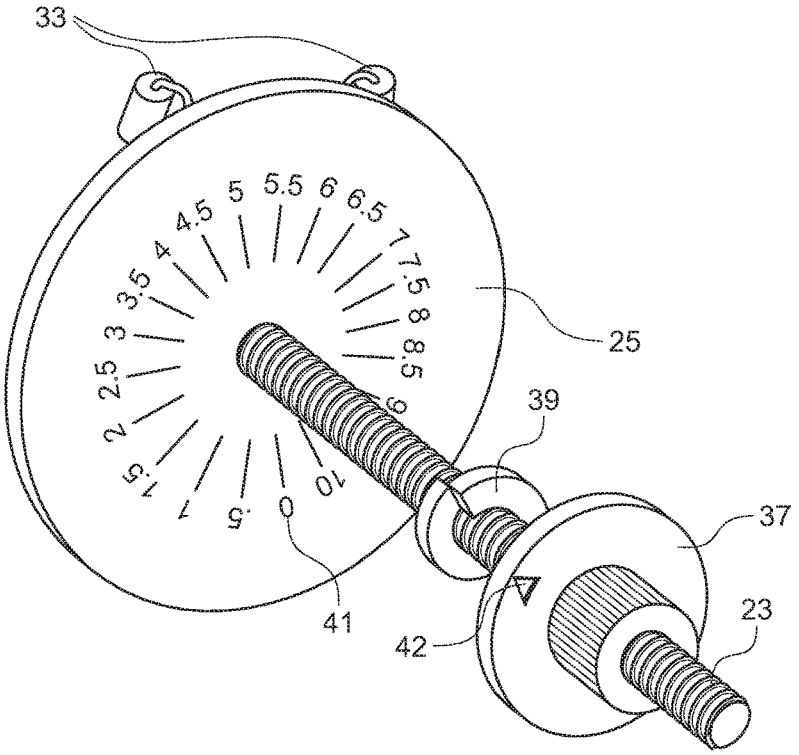
FIG. 6 is a side elevation view of the graduated tension indicator mounted on the central pedestal showing the lock washer and the nut according to a preferred embodiment.
Figure 7:
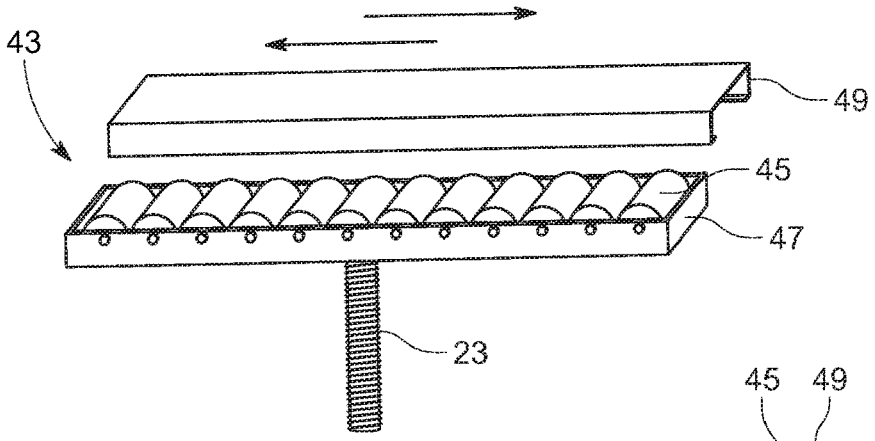
FIG. 7 is a side elevation view of the radial adjusting system mounted on the pedestal according to a preferred embodiment.
Figure 8:
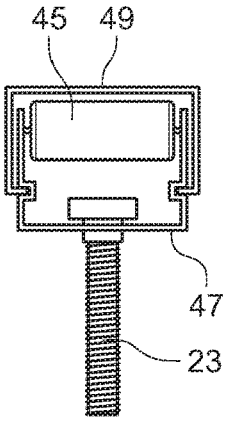
FIG. 8 is a cross-sectional view of the radial adjusting system mounted on the pedestal according to a preferred embodiment.
Figure 9:
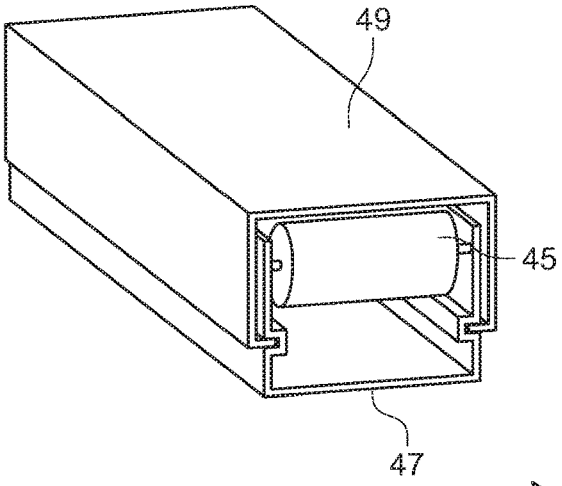
FIG. 9 is a side elevation view of the radial adjusting system according to a preferred embodiment.
Figure 10:
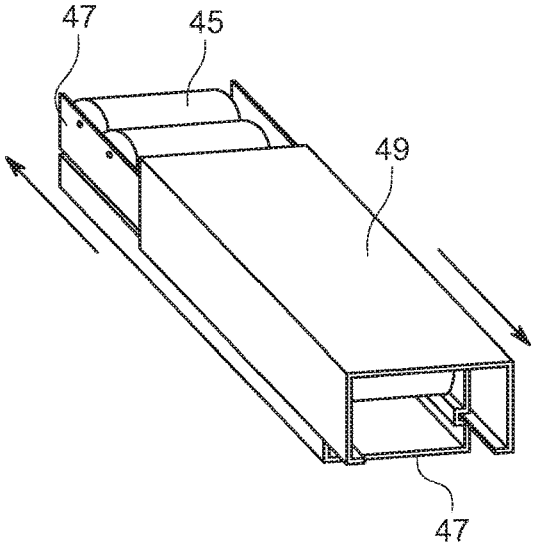
FIG. 10 is a side elevation view of the radial adjusting system after a radial movement according to a preferred embodiment.

The adjustable resistance system may also comprises a graduated tension indicator 41 mounted on the friction plate, as shown in FIGS. 5 and 6. In a preferred embodiment, the graduated tension indicator 41 comprises a numerical scale for indicating the level of resistance associated with the upward screw movement of the nut 37 or the downward unscrew movement of the nut 37. The nut may contain a mark 42, such as an arrow, to indicate the level of resistance, where level zero (0) may be associated with the minimum of friction or the substantially antifriction interaction of the lateral sliding system 9. The nut 37 may be accessible below the base 5 for adjusting the level of resistance. In a preferred embodiment, the nut 37 is accessible by an aperture 40 in this floor 12, as shown in FIG. 4.

Referring now to FIGS. 7-10, the device may comprise a radial adjusting system 43 mounted under each support member 7. The radial adjusting system 43 is configured to move the support member in a radial direction of the curved rail 3 for adjusting the position of the portion of the leg during the lateral movement. By allowing such radial movement during operation, the radial adjusting system 43 might help to fine tune the lateral movement in case where the initial positioning of the portion of the legs on the support members 7 is not perfectly align with the hip-joint axe of rotation in accordance to the specific physical therapy.

In a preferred embodiment, the radial adjusting system 43 comprises a bearing mechanism 45 including a series of wheels 45 aligned in a bearing casing 47, which is connected to the central pedestal 23, and a bearing cover 49, which is connected under each support member 7. The bearing cover 49 is adapted to move forward or backward over the bearing casing 47 on a short distance, such as 20 mm long, causing the radial movement of the support members 7.

Figure 11:
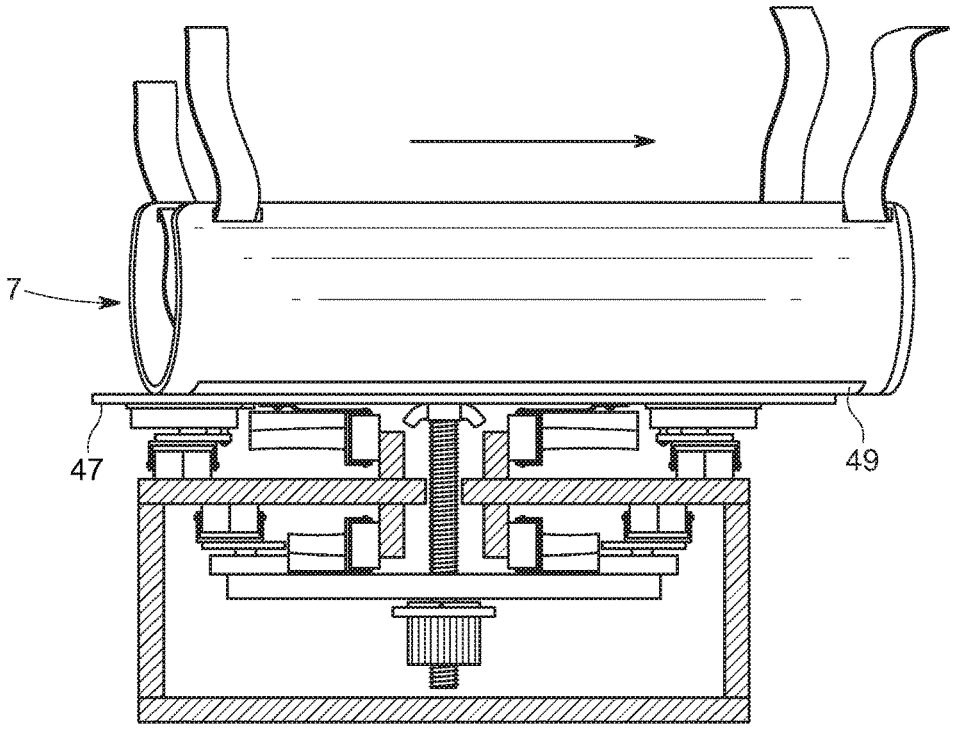
FIG. 11 is a side view of the device according to a preferred embodiment of the present invention with the radial adjusting system after a radial movement.
Figure 12:
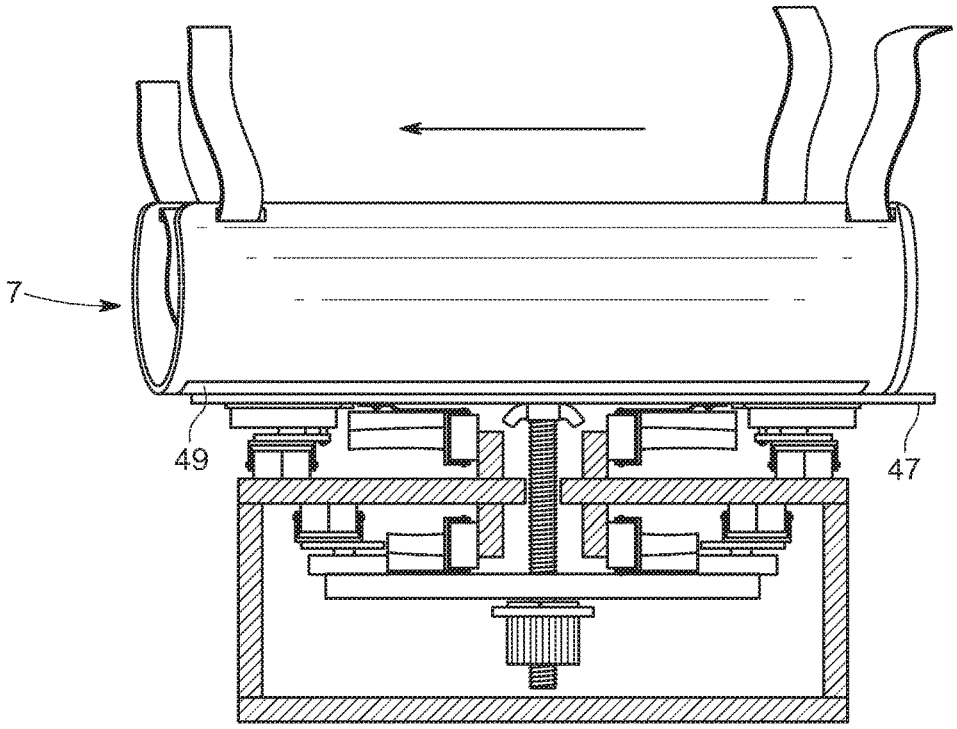
FIG. 12 is a side view of the device according to a preferred embodiment of the present invention with the radial adjusting system after a radial movement in opposite direction to the one illustrated in FIG. 11.

FIGS. 11 and 12 shows an example of a support member 7 attached to a radial adjusting system 43. In this embodiment, the lateral sliding system 9 is connected to the radial adjusting system 43.

FIGS. 1-4 and 11-12 also show that the support members 7 may comprise a securing system 50 for securing the portion of the leg of the person during a physical therapy. Such securing system 50 can consist of attaching means like ribbon or cord with fasteners such as, but not limited to, hook and loop fastener (Velcro™) or snapclip system. As aforesaid, the support member 7 is adapted to accommodate a portion of a leg of a person. In a preferred embodiment, the support member 7 has a curved shape adapted to support a foreleg of a person. The support member 7 may be made of semi-rigid material, such as but not limited to, plastic or Polyvinyl chloride (PVC), and may contain paddings to improve the comfort of the foreleg on the support member 7. Moreover, the support member 7 may be connected to the pedestal 23 by a central fastener 57.

The support members 7 may be configured to be demountable from the base so that they can be easily replaced by a different type or size of support members 7.

Figure 13:
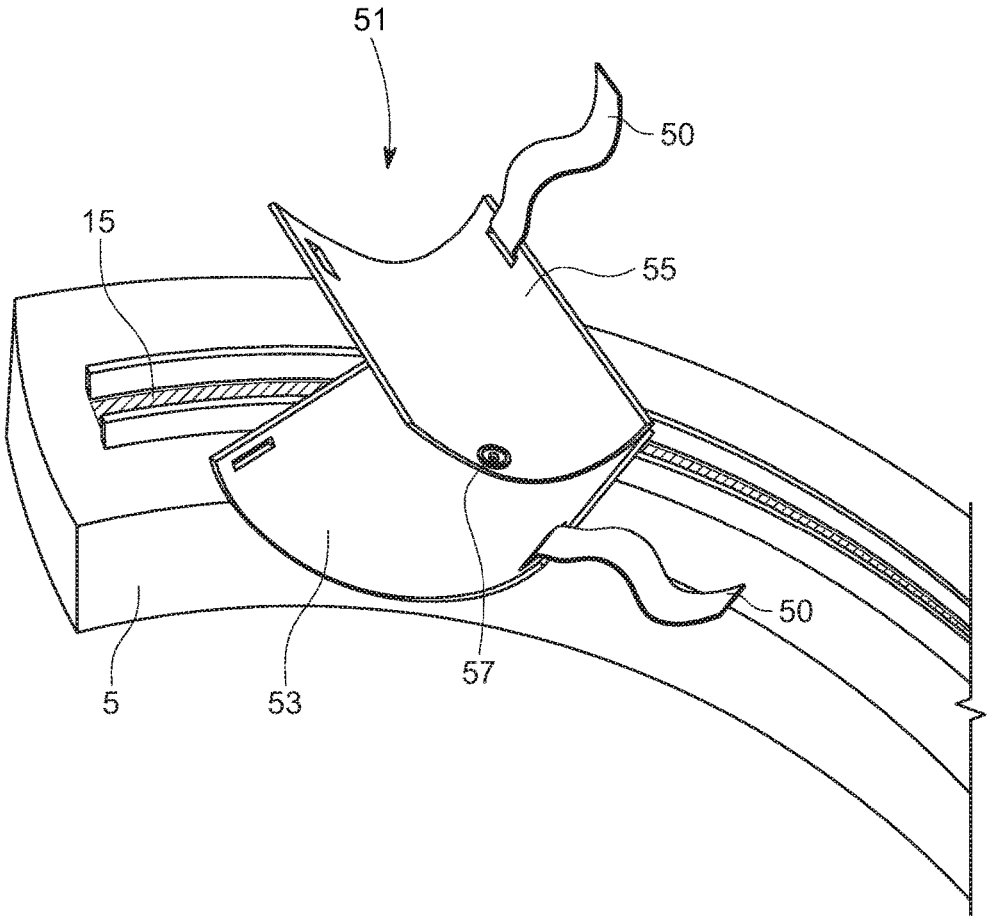
FIG. 13 is a side elevation view of a portion of the device with the second support member mounted thereon according to another embodiment.

In accordance with another embodiment of the present invention, FIG. 13 shows a second support member 51 adapted to accommodate a knee of a person who is lying on the side in a lateral decubitus position for allowing sagittal plane motion. This second support member 51 comprises a foreleg section 53 and a thigh section 55 pivotally attached by a central fastener 57 for allowing adjustment of the position of the knee on the second support member 51. Similarly to the afore-mentioned support member 7, this central fastener 57 may be connected to the pedestal 23. Also, the second support member 51 may be made of semi-rigid material, such as but not limited to, plastic, and may contain padding to improve the comfort of the knee on the second support member 51.

In accordance with another embodiment of the present invention, it is provides a method for a physical therapy of lower limbs of a person, comprising the steps of positioning a portion of a leg of the person on a pair of support member 7 configured to slide along a curved shaped rail 3, and then moving the support members 7 in a lateral movement along the rail 3. Such movement is driven by the force of the lower limbs of a person during a bilateral or unilateral physical therapy.

Figure 14:
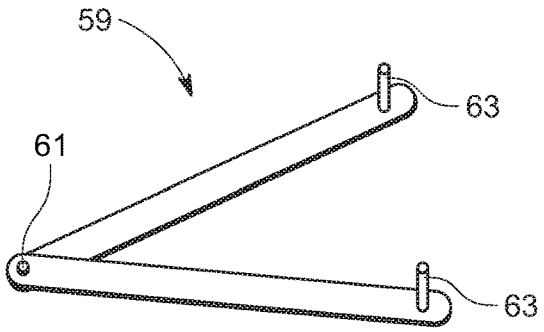
FIG. 14 is top elevated view of the guiding member according to a preferred embodiment.
Figure 15:
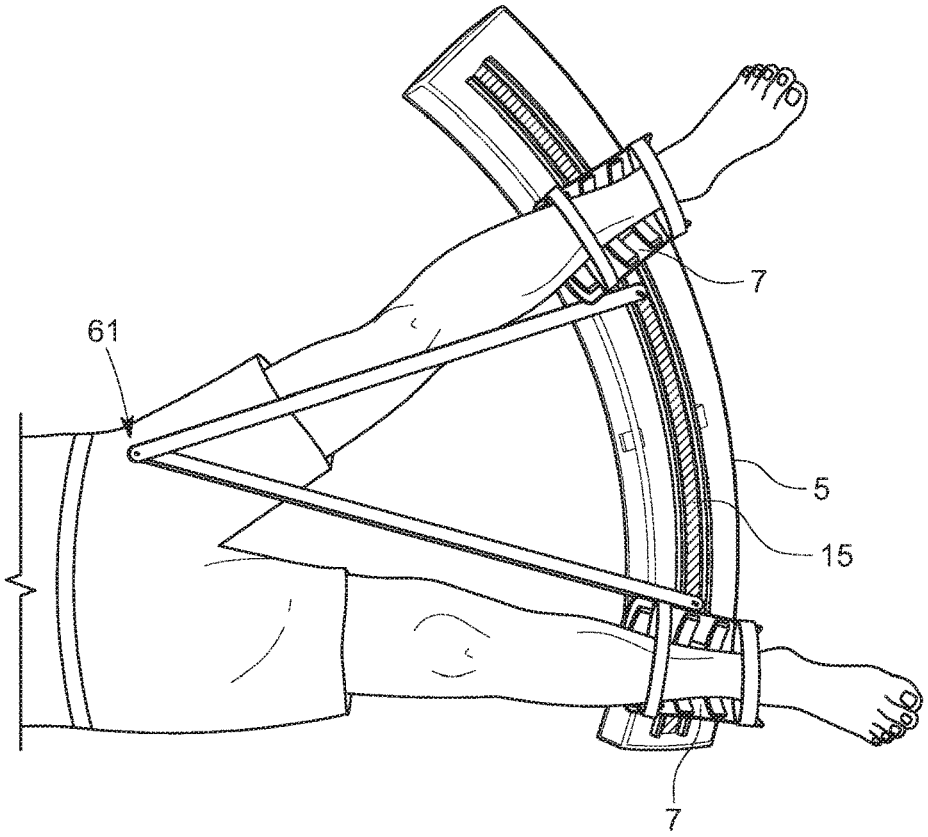
FIG. 15 is top elevated view which illustrates use of an example guiding member by a patient for positioning the device according to a preferred embodiment.

For the frontal plane motion, a person may use a guiding member 59, as shown in FIGS. 14 and 15, in order to facilitate the proper positioning and to align the lower limbs on the support member along with the hip-joint axe of rotation, also known as the acetabulofemoral joint. The guiding member 59, which looks like a large compass, comprises two branches pivotally attached at the joint extremity 61. The other extremity of each branch comprises a pin 63 adapted to fit inside the slot 15. In the aforesaid preferred embodiment, the length of each branch of the guiding member 59 is about 737 mm, i.e. a length similar to the radius of the curved rail 3. For installing the lower limbs on the device 1, each pins 63 are inserted in the slot 15, while the joint extremity 61 is aligned with the hip-joint axe of rotation, as shown on FIG. 15. Once aligned, the guiding member 59 is then put aside, so that the physical therapy can begin.

Figure 16:
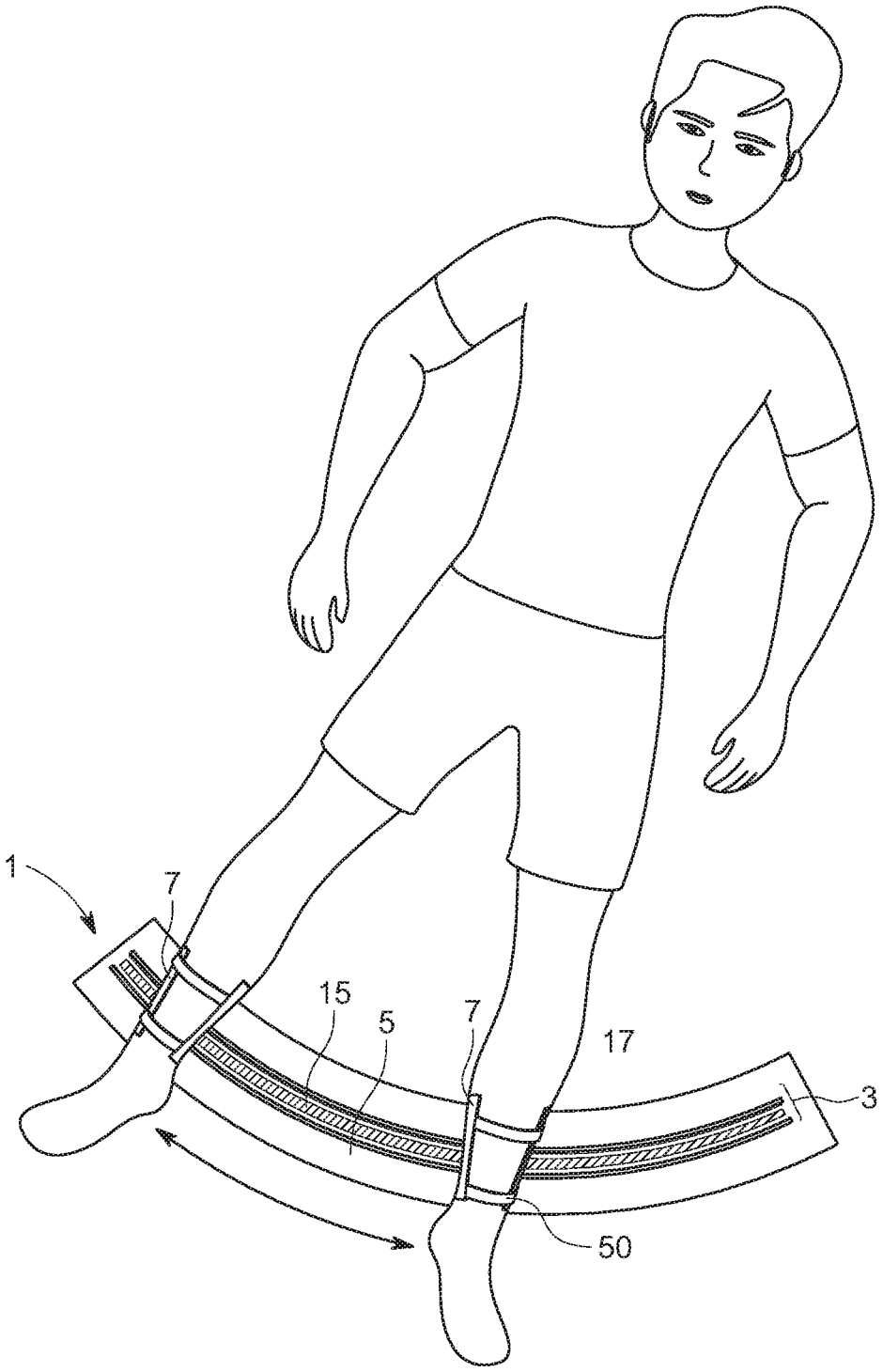
FIG. 16 is a top view which illustrates use of an example device for a frontal plane motion while the patient is in dorsal decubitus position with extended legs secured on a support member.

FIGS. 16-20 show examples of positions and movements that can be performed with the device 1. FIG. 16 shows the frontal plane motion while the person is in dorsal decubitus position with extended legs, where the forelegs of the person are secured on each support members 7 for abduction or adduction of the legs.

Figure 17:
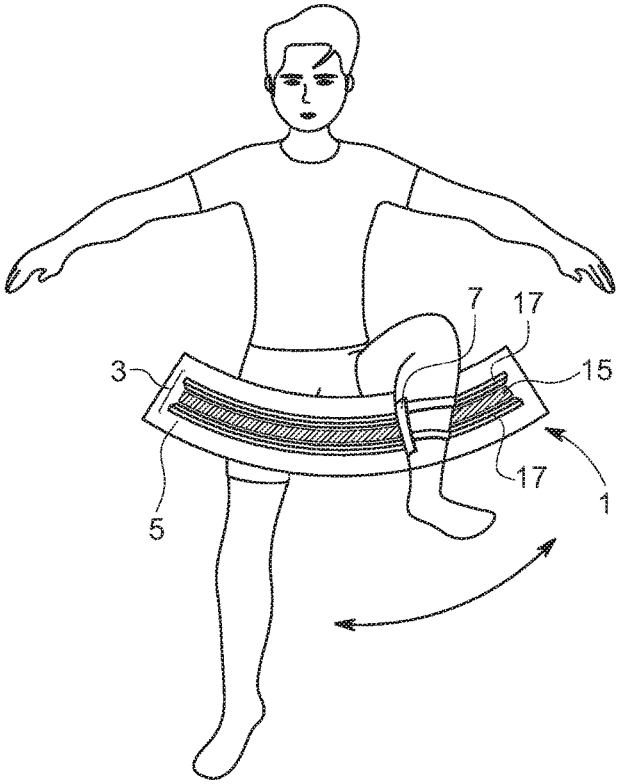
FIG. 17 is a top view which illustrates use of an example device for a horizontal plane motion while the patient is in dorsal decubitus position with one bent leg secured on a support member.
Figure 18:
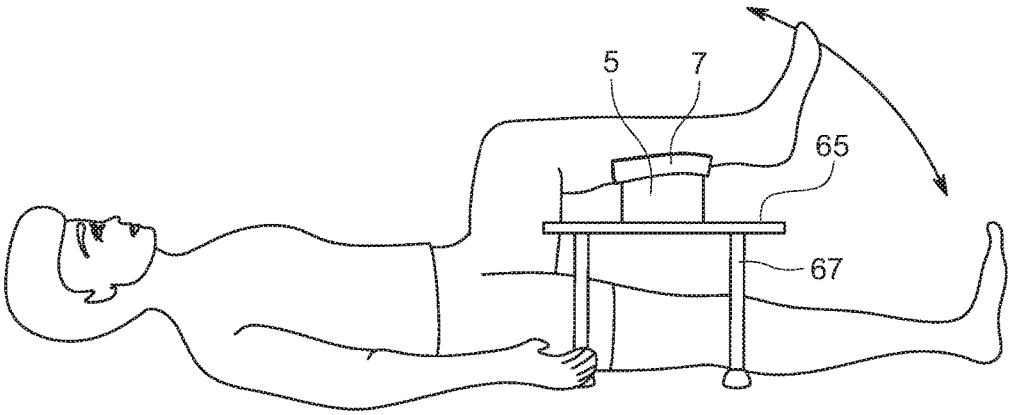
FIG. 18 is a side view which illustrates use of an example device for a horizontal plane motion while the patient is in dorsal decubitus position with one bent leg secured on a support member.
Figure 21:
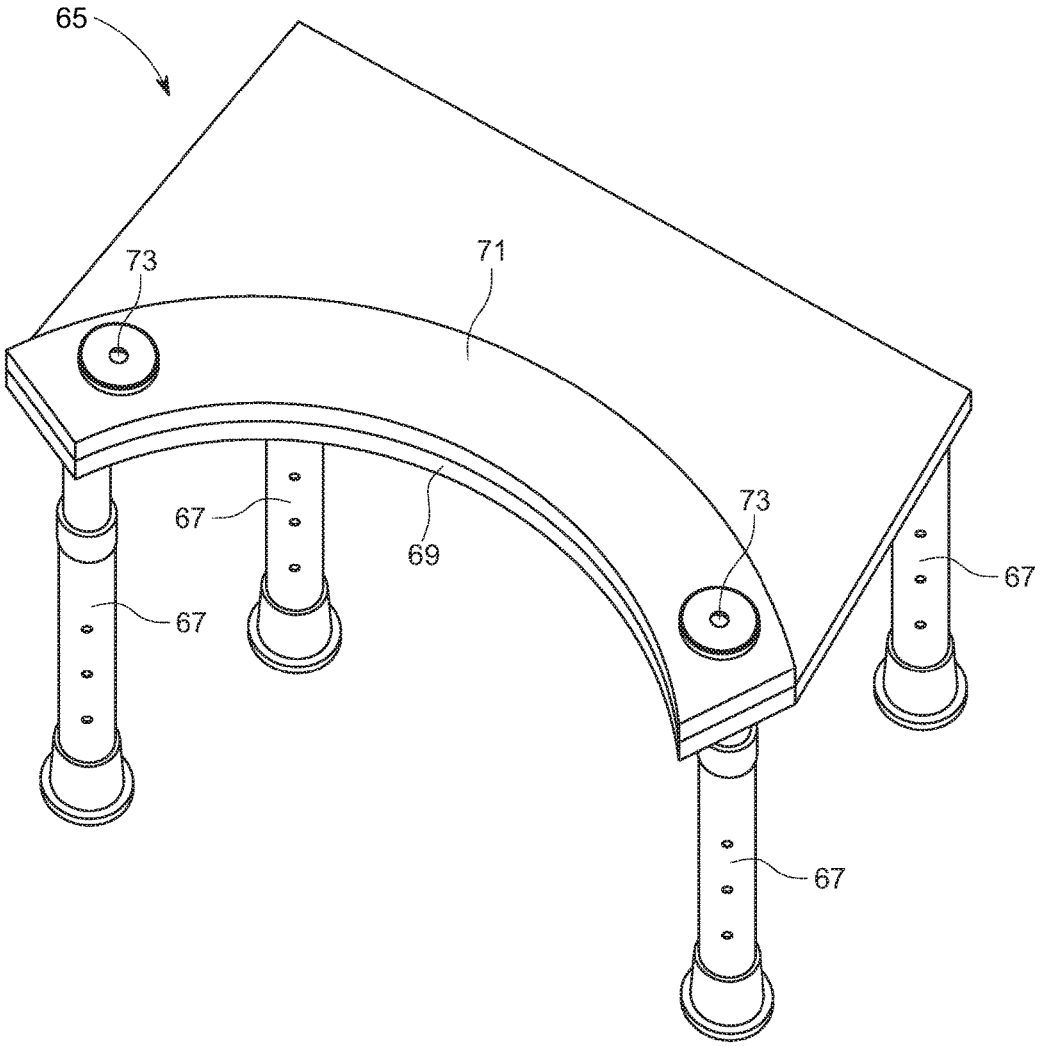
FIG. 21 is a top elevated view of the table shown without the device.
Figure 22:
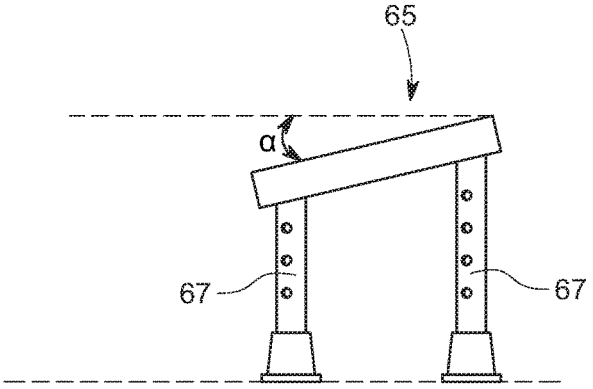
FIG. 22 is a side view of the table shown without the device illustrating the inclination of the table.
Figure 23:
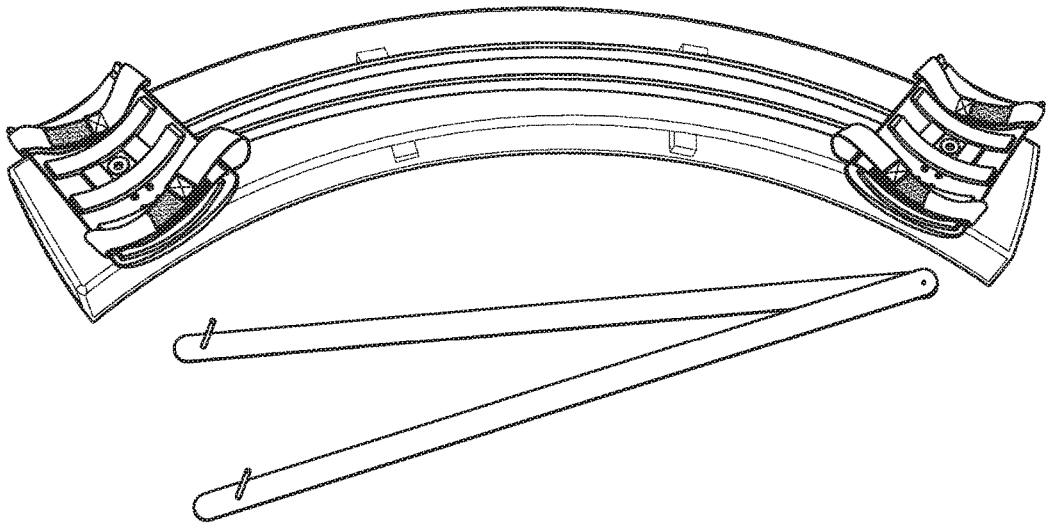
FIG. 23 is a top picture view of the device and the guiding member according to a preferred embodiment of the present invention.
Figure 24:
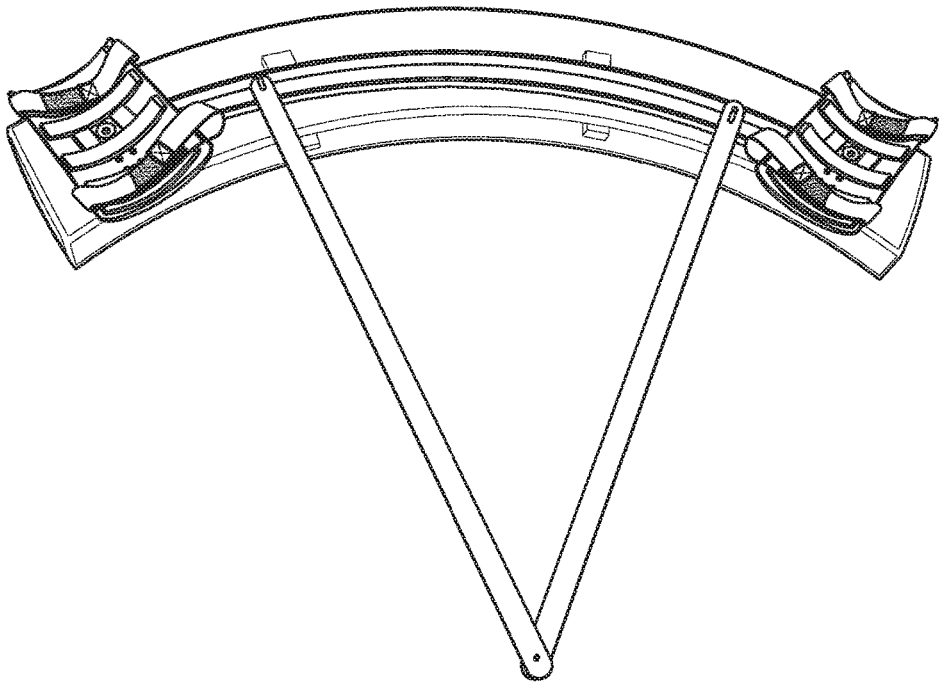
FIG. 24 is a top picture view of the device with the guiding member in place according to a preferred embodiment of the present invention.
Figure 25:
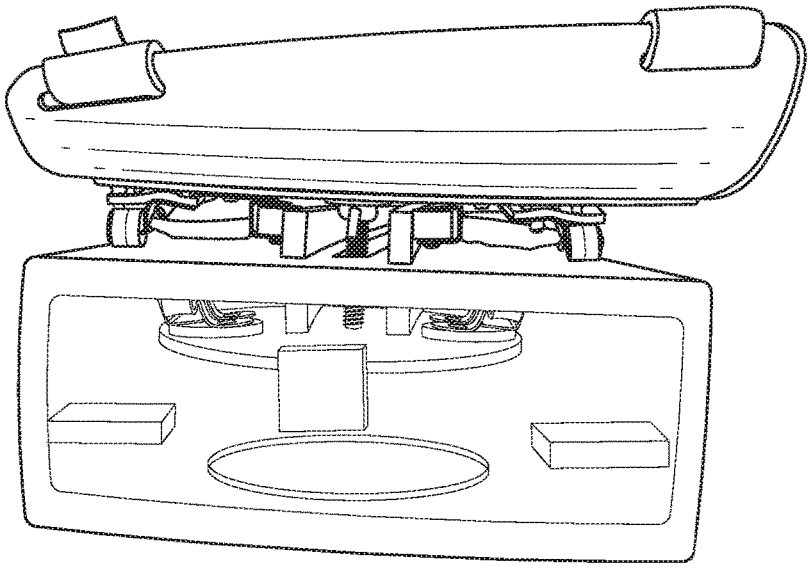
FIG. 25 is a lateral picture view of the device according to a preferred embodiment of the present invention.
Figure 26:
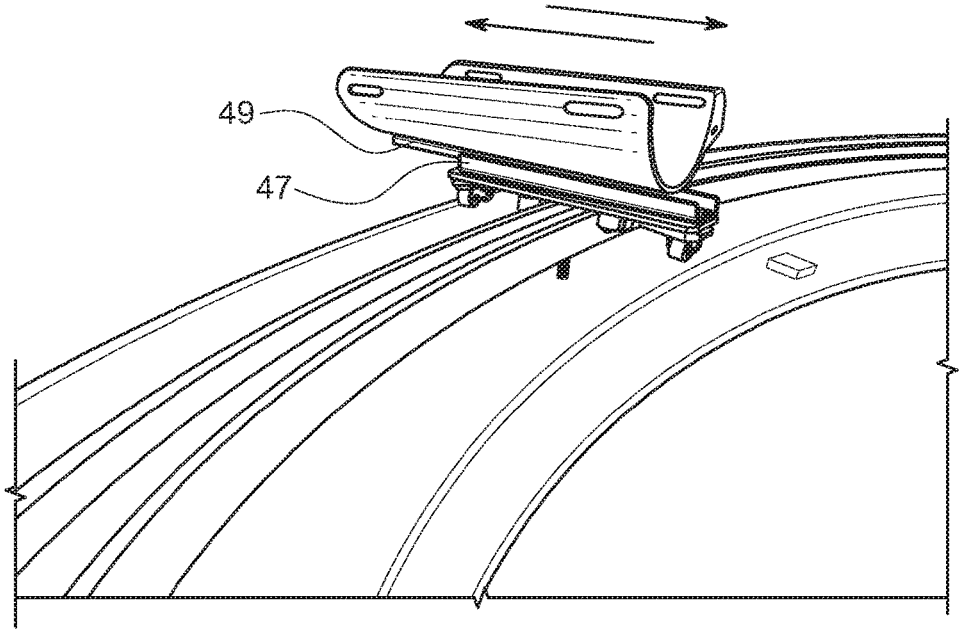
FIG. 26 is a lateral and partial picture view of the device according to a preferred embodiment of the present invention.
Figure 27:
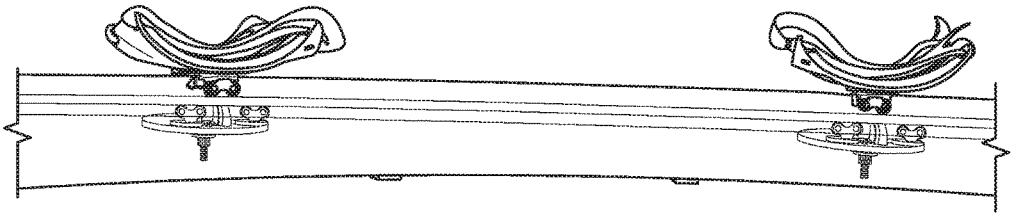
FIG. 27 is a front picture view of the device according to a preferred embodiment of the present invention.
Figure 28:
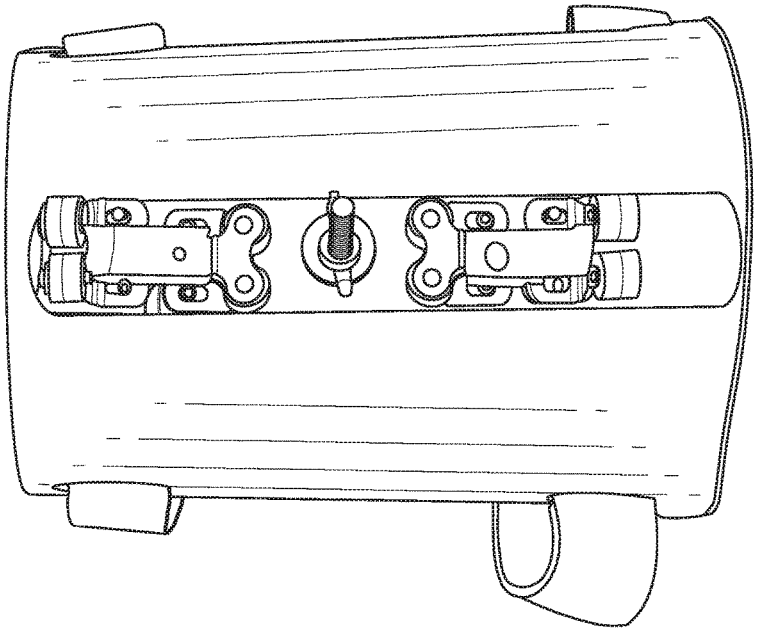
FIG. 28 is a picture of the rear section of the leg support member according to a preferred embodiment of the present invention.
Figure 29:
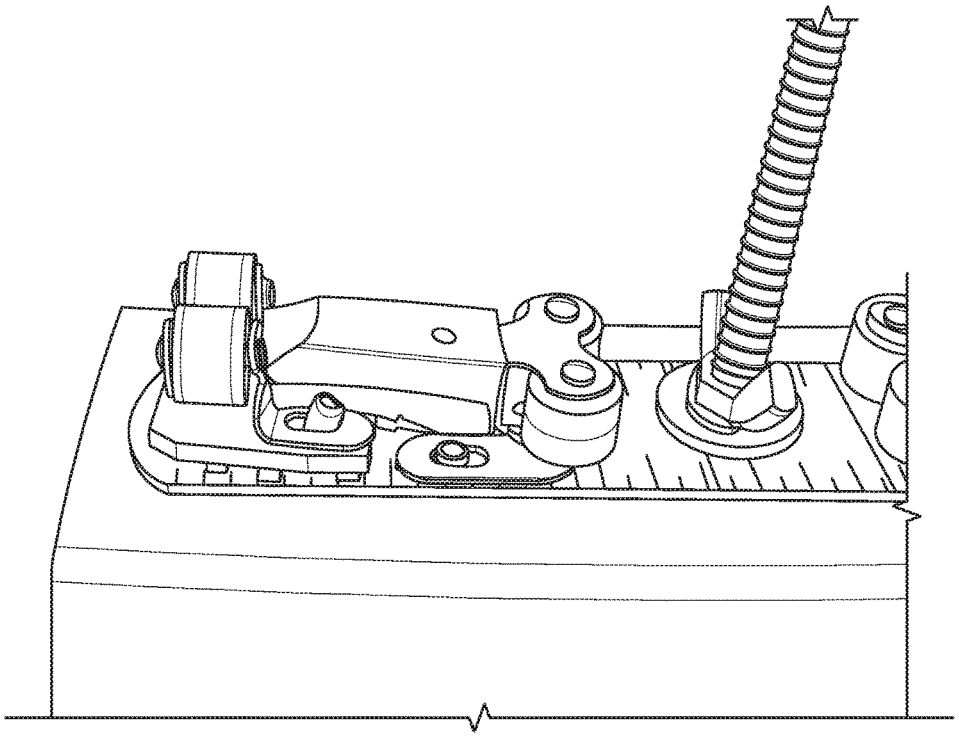
FIG. 29 is a close-up picture of the sliding mechanism in the rear section of the support member according to a preferred embodiment of the present invention.
Figure 30:
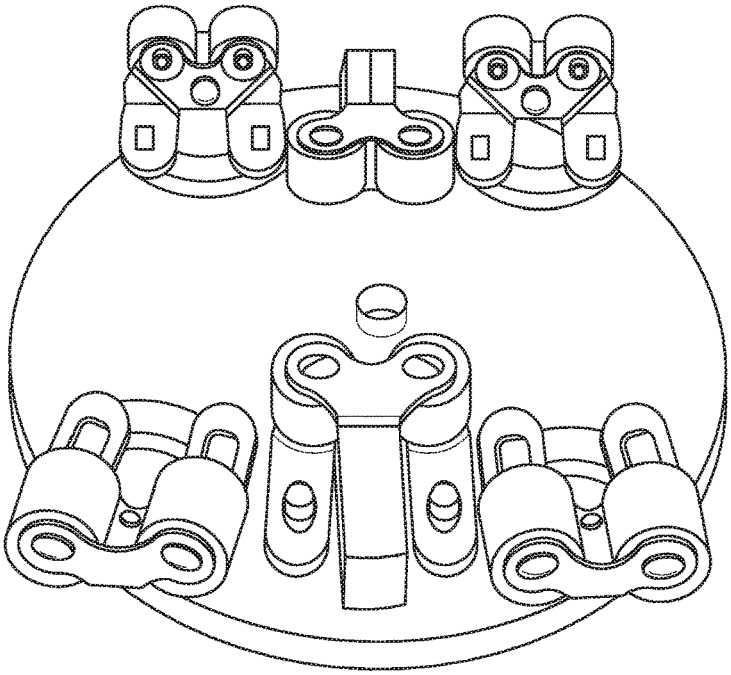
FIG. 30 is a close-up picture of the second part of the sliding mechanism of the support member according to a preferred embodiment of the present invention.
Figure 31:
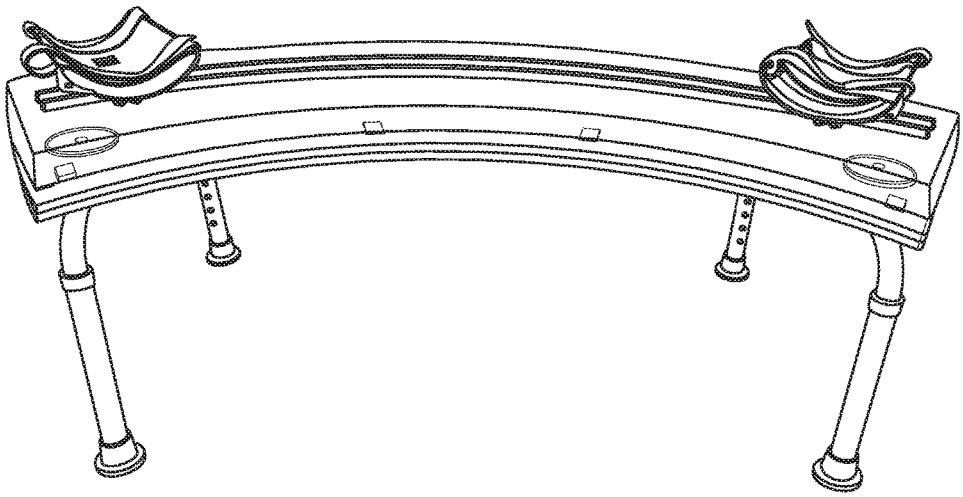
FIG. 31 is a picture of the device installed on a bench according to a preferred embodiment of the present invention.
Figure 32:
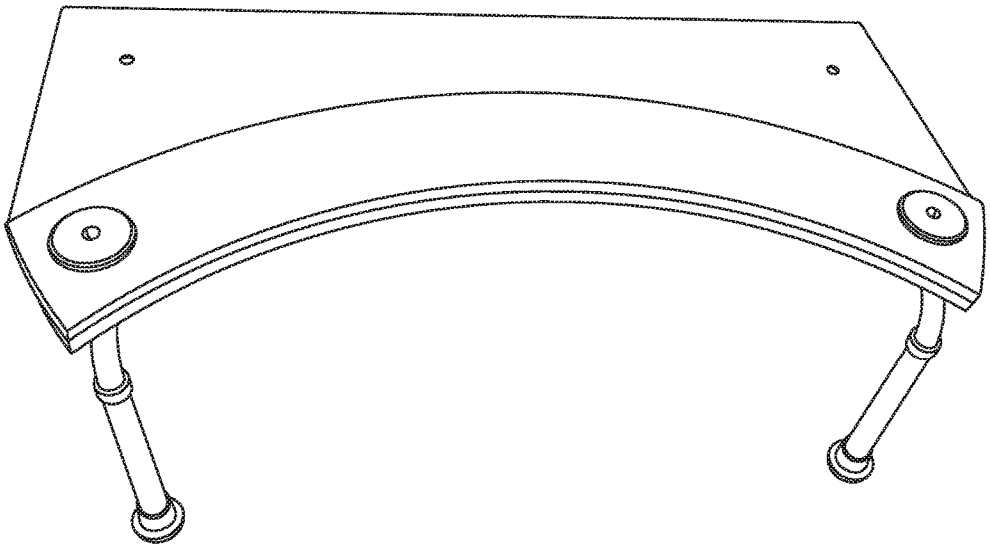
FIG. 32 is a picture of a the specific bench used for supporting the device according to a preferred embodiment of the present invention.

FIGS. 17-18 shows the horizontal plane motion while the person is in dorsal decubitus position with one bent legs, such as the foreleg of the bent leg is secured on a support member 7 for internal and external rotation of the hip. For this particular physical therapy exercise, the device has to be elevated at the height of the foreleg of the bent leg, whereas the other leg, i.e. the extended leg, can be placed underneath the device for more comfort, as shown in FIG. 18. Therefore, the device 1 may be disposed on an elevated support such as the table 65, which is shown without the device in FIGS. 21 and 22. This table 65 may be configured to adjust its height to the level of the foreleg of the person and to adjust its inclination for the desired knee flexion, as shown in FIG. 18. These adjustments of the table 65 can be performed by using height adjustable table feet or legs 67. Moreover, the table 65 may comprise a curved frontal edge 69, for allowing more freedom of movement of the leg during operation. The table 65 may further comprise a platform 71 having a curve shape similar to the shape of the device for positioning adequately the device on the table. This platform may also comprise stabilizer members 73 adapted to fit inside the aperture 40 of the floor of the base, for orienting and stabilizing the good position of the device 1 on the table 65.

Figure 19:
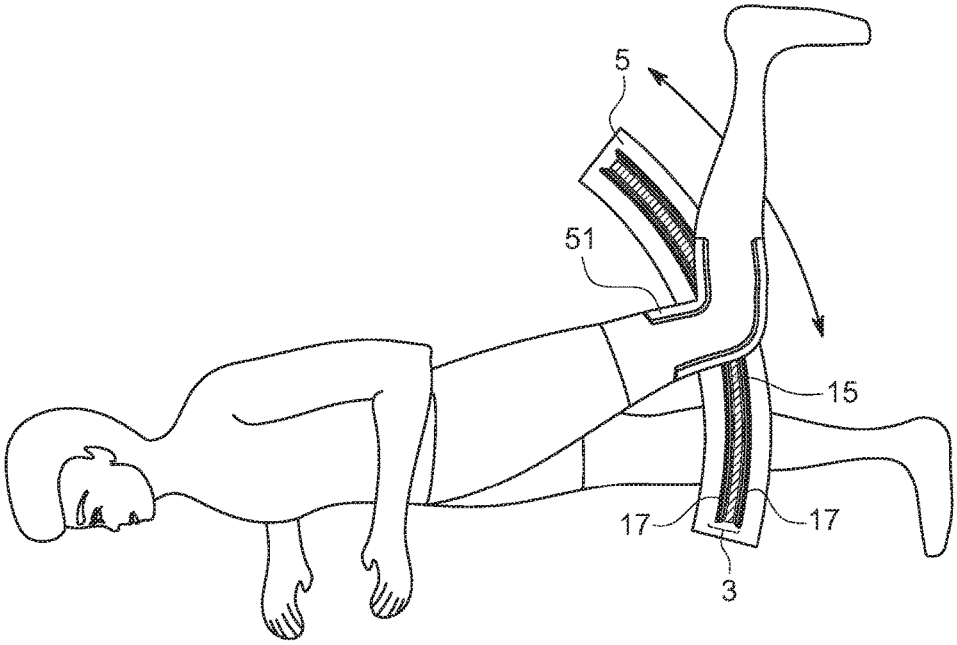
FIG. 19 is a top view which illustrates use of an example device for a sagittal plane motion while the patient is in lateral decubitus position with one knee secured on a second support member.
Figure 20:
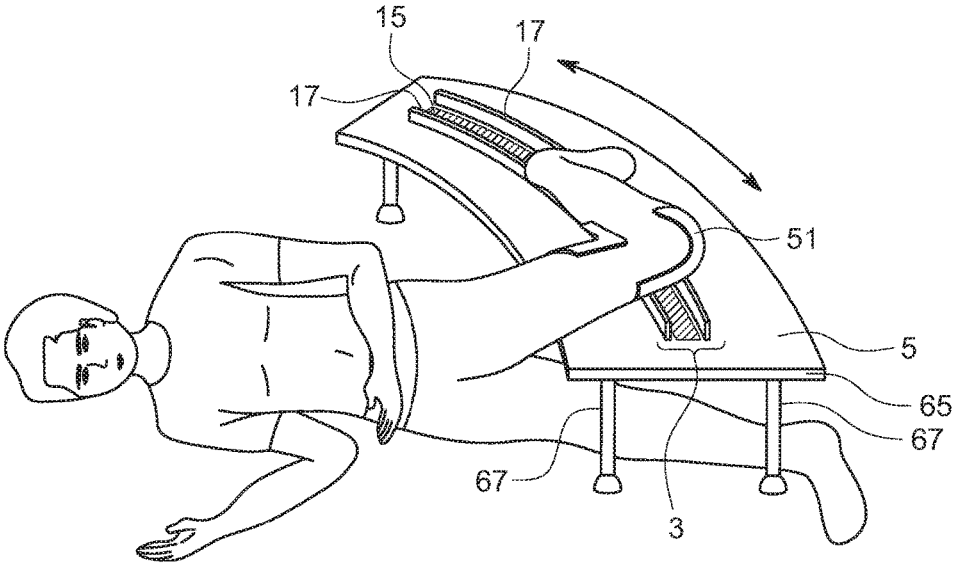
FIG. 20 is a side elevated view which illustrates use of an example device for a sagittal plane motion while the patient is in lateral decubitus position with one knee secured on a second support member.

FIGS. 19-20 shows the sagittal plane motion while the person is in lateral decubitus position, such as one knee of the person is secured on a second support member 51 for hip flexion and extension. For this particular physical therapy exercise, the device has to be elevated at the height of the knee of the bent leg, whereas the other leg, i.e the extended leg, can be placed underneath the device for more comfort, as shown in FIG. 20. Therefore, the device 1 may be disposed on an elevated support such as the table 65, which is shown without the device in FIGS. 21 and 22. As aforesaid, this table 65 may be configured to adjust its height and inclination to the level of the knee of the person lying on the side, as shown in FIG. 20.

Finally, FIGS. 23 to 32 are pictures of the device according to a preferred embodiment of the present invention, as previously described in the drawings and specification.

Figure 33:
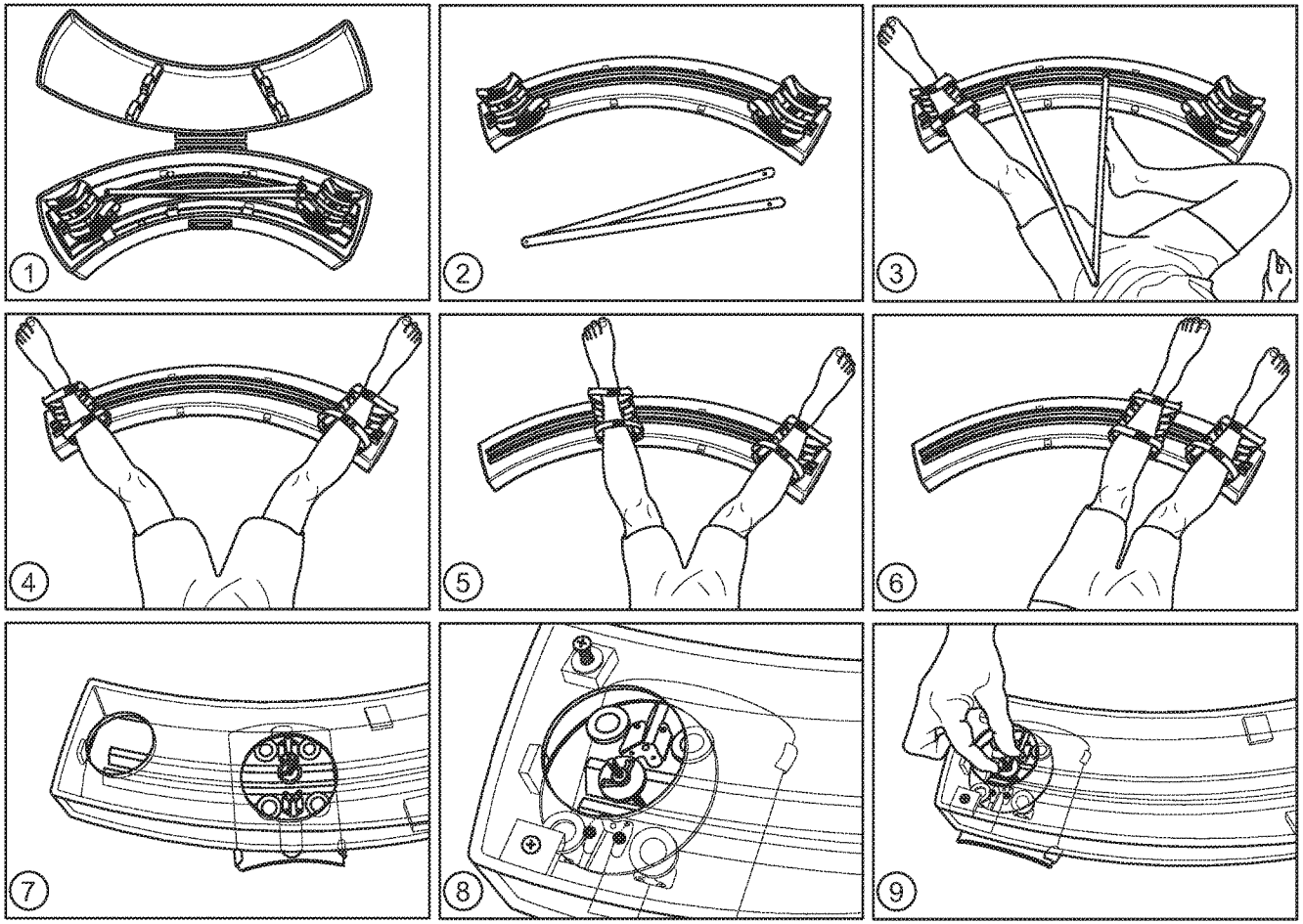
FIG. 33 is a plurality of pictures illustrating the method of using the device according to a preferred embodiment of the present invention.

FIG. 33 presents additional pictures showing the invention:

Picture 1 shows the device and accessories in a box having a shape specifically adapted to contain the curved rail. The box can be made of plastic, wood or other material like wood.

Picture 2 shows the curved rail and the guiding member outside the box.

Picture 3 shows a man having his left leg installed on one the supporting sliding member for performing unilateral therapy. The guiding member is installed for positioning his lower limb in the adequate position for therapy.

Pictures 4 to 6 show a man having his left and right legs each installed on the supporting sliding members for performing bilateral therapy. The left leg is moving from the left side of the curved rail (picture 4) to the right side (picture 6) while the right leg does move and stays on the right side of the rail.

Pictures 7 and 8 show the back side of the curved rail. The transparent Plexiglas® curved support allows seeing the sliding mechanism.

Finally, picture 9 shows the man adjusting the sliding force by turning the nut of the sliding mechanism.

Indeed, as shown on Picture 9 of FIG. 33, in addition to the other advantages of the present invention discussed herein, the device may also allow for variation in the resistance in conjunction with the strength curve requires by the particular physical therapy or along with the strength improvement of a person in time.

The device may be adapted for a variety of physical therapy of the lower limbs along different planes. In particular, the device may be configured for frontal plane motion like abduction or adduction of the legs, while the person is in dorsal decubitus position with extended legs. Such movement may help to reinforce the adductor and abductor. Also, the device may be configured for horizontal plane motion allowing for hip internal and external rotation, while the person is in dorsal decubitus position with one bent leg. The device may also be configured for sagittal plane motion allowing for hip flexion and extension, while the person is in lateral decubitus position.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A device for unilateral or bilateral physical therapy of lower limbs of a person, the device comprising a curved rail mounted on a base and a pair of support members connected to the curved rail, each support member being configured to hold a portion of a leg of the person and to slide along the curved rail, wherein:

the curved rail is configured to allow lateral movements of the lower limbs with the support members, said lateral movements being driven by a force of the lower limbs;

the base comprises a top portion for supporting the curved rail and at least two side longitudinal walls for supporting the top portion, the base defining a curved slot along a mid-section of the top portion, the curved rail comprising a pair of guidance plates located along edges of the curved slot, each guidance plate defining a top section extending outwardly from the top portion of the base and a lower section extending inwardly from the top portion of the base;

each support member comprises a lateral sliding system engaging the curved rail with substantially antifriction interaction for facilitating lateral movements of the respective support member along the curved rail;

the lateral sliding system of each support member comprises a plurality of wheels supported by a central pedestal extending from each support member through the curved slot inside the base and under the top portion of the device for guiding the lateral movements of the respective support member along the curved rail; and the lateral sliding system of each support member further comprises a friction plate connected to the central pedestal.

2. The device of claim 1, wherein the plurality of wheels comprises:

a pair of top guidance wheels operatively attached to the support member and configured to engage the top section of the guidance plates;

a pair of top friction wheels operatively attached to the support member and configured to engage the top portion of the base;

a pair of lower guidance wheels operatively attached to the friction plate, and configured to engage the lower section of the guidance plates, and a pair of lower friction wheels operatively attached to the friction plate and configured to engage the top portion of the base.

3. The device of claim 2, further comprising damping pads located between the top friction and/or top guidance wheels and the support member, and/or between the lower friction and/or lower guidance wheels and the friction plate, for reducing vibration during the lateral movements of the respective support member.

4. The device of claim 2, wherein each lateral sliding system further comprises an adjustable resistance system for increasing interactions between the plurality of wheels and the top portion of the base along the curved rail to obtain a level of resistance adapted to the force required by the lower limbs to move the respective support member along the curved rail during the physical therapy.

5. The device of claim 4, wherein the adjustable resistance system is adjustable on each lateral sliding system independently.

6. The device of claim 5, wherein the adjustable resistance system of one lateral sliding system is adapted to be adjusted at a maximum level of friction to block the lateral movement of one of the support members, leaving the other support member movable for a unilateral physical therapy exercise.

7. The device of claim 4, wherein the adjustable resistance system comprises a nut mounted on the central pedestal below the friction plate, the nut being adapted to engage complementary threads on the central pedestal whereby, in use, an upward screw movement of the nut pushes the friction plate towards the top portion of the base and pulls the respective support members towards the top portion of the base, for increasing a friction of the plurality of wheels, and a downward unscrew movement of the nut reduces said friction of the plurality of wheels.

8. The device of claim 7, wherein the adjustable resistance system further comprises a lock washer mounted on the central pedestal located between the nut and the friction plate for preventing a disengagement of the nut upon vibration.

9. The device of claim 7, wherein the adjustable resistance system further comprises a graduated tension indicator mounted on the friction plate for indicating the level of resistance associated with the upward screw movement of the nut or the downward unscrew movement of the nut.

10. The device of claim 8, wherein the adjustable resistance system further comprises a graduated tension indicator mounted on the friction plate for indicating the level of resistance associated with the upward screw movement of the nut or the downward unscrew movement of the nut.

11. The device of claim 1, further comprising a radial adjusting system mounted under each support member and configured to move the respective support member in a radial direction of the curved rail, for adjusting a position of the portion of the leg during the lateral movements.

12. The device of claim 11, wherein the lateral sliding system is attached to the radial adjusting system.

13. The device of claim 1, wherein the support members further comprise a securing system for securing the portion of the leg of the person during the unilateral or bilateral physical therapy.

14. The device of claim 1, further comprising a guiding member configured for positioning the device in line with a rotation axis of the lower limbs of the person, the guiding member having two branches pivotally attached at one end of each branch, another end of each branch being configured to be demountably connected with the curved rail.

15. Use of the device of claim 1 for physical therapy of a lower limb of a person, the use comprising the steps of:

a) positioning a portion of a leg of the person on a support member; said support member being configured to slide along a curved rail mounted on a base; and b) moving the support member in a lateral movement along the curved rail, said movement being driven by a force of the lower limb of the person during unilateral physical therapy.

16. Use of the device of claim 1 for physical therapy of lower limbs of a person, the use comprising the steps of:

a) positioning a portion of a first leg of the person on a first support member, said first support member being configured to slide along a curved rail mounted on a base;

b) positioning a portion of a second leg of the person on a second support member, said second support member being configured to slide along the curved rail mounted on the base; and c) moving the first and second support members in lateral movements along the curved rail, said lateral movements being driven only by a force of the lower limbs of the person during a bilateral physical therapy.

* * * * *